US008825313B2

(12) United States Patent
Abel et al.

(10) Patent No.: US 8,825,313 B2
(45) Date of Patent: Sep. 2, 2014

(54) CRANE CONTROL SYSTEM AND CRANE

(75) Inventors: Peter Abel, Mengen (DE); Edwin Cettinich, Schelklingen-Justingen (DE); Ulrich Fuchs, Neu Ulm (DE); Oliver Ruoss, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 13/555,996

(22) Filed: Jul. 23, 2012

(65) Prior Publication Data

US 2013/0024077 A1 Jan. 24, 2013

(30) Foreign Application Priority Data

Jul. 21, 2011 (DE) ..... 10 2011 108 284

(51) Int. Cl.
*B66C 13/16* (2006.01)
*B66C 23/90* (2006.01)
*B66C 13/18* (2006.01)

(52) U.S. Cl.
CPC ..... *B66C 13/18* (2013.01); *B66C 23/905* (2013.01)
USPC ..... 701/50; 212/282

(58) Field of Classification Search
USPC ..... 701/50; 212/278, 279, 282, 283
See application file for complete search history.

(56) References Cited

U.S. PATENT DOCUMENTS

| | | | | |
|---|---|---|---|---|
| 5,842,143 | A * | 11/1998 | Lohrenz et al. | 701/30.3 |
| 7,252,203 | B2 * | 8/2007 | Frankenberger et al. | 212/279 |
| 7,635,063 | B2 * | 12/2009 | Dennis | 212/292 |
| 2004/0030478 | A1 * | 2/2004 | Holland et al. | 701/50 |
| 2005/0247656 | A1 * | 11/2005 | Sparenborg et al. | 212/276 |
| 2009/0008351 | A1 * | 1/2009 | Schneider et al. | 212/272 |

FOREIGN PATENT DOCUMENTS

| | | | |
|---|---|---|---|
| DE | 19538264 | A1 | 4/1997 |
| DE | 10023418 | A1 | 11/2001 |

* cited by examiner

*Primary Examiner* — Mary Cheung
*Assistant Examiner* — Rodney Butler
(74) *Attorney, Agent, or Firm* — Alleman Hall McCoy Russell & Tuttle LLP

(57) ABSTRACT

A crane control system with a display and entry unit for showing and entering the crane operating mode information that is required for the load moment limiting and/or the crane control, especially corresponding to its current mechanical layout, wherein the crane control system comprises a logic that determines application and/or outfitting related dependencies between two or more input parameters.

14 Claims, 4 Drawing Sheets

CRANE CONTROL SYSTEM AND CRANE

CROSS REFERENCE TO RELATED APPLICATION

This application claims priority to German Patent Application No. 10 2011 108 284.4, entitled "Crane Control System and Crane," filed Jul. 21, 2011, which is hereby incorporated by reference in its entirety for all purposes.

TECHNICAL FIELD

The present disclosure concerns a crane control system with a display and entry unit for showing and entering the crane operating information required for the limiting of the load moment and/or the control of the crane, especially in regard to its current mechanical layout.

BACKGROUND OF THE INVENTION

During the working of the crane or the outfitting process, the load moment limiting monitors the load moment currently applied in terms of defined limit values that are generally kept in corresponding carrying load tables. Therefore, prior to each use of the crane, necessary data and operating mode information of the crane has to be entered into the crane control system in order to provide a suitable carrying load table for the load moment limiting.

Thus far, crane control systems are known that have an entry and display unit for entering the required data. The crane operator first determines a required entry parameter and then obtains from the crane control system a list with all possible setups for the crane via the display unit. The list provided must be scrolled through for the desired setup, and after the desired setup is found, it is adopted by a user confirmation as the input for the parameter being configured. This process is repeated until all required parameters have been properly set.

Possible parameters are, for example, the length of the telescoping jib or lattice jib of a crane and information about crane accessories, the ballast, the crane bracing or the crane turning zone. The number of setups for each individual parameter is variable and can sometimes take on very high values. For example, a suitable selection of setups must be provided for each possible crane configuration. In particular, broad configuration possibilities exist for the jib system, since differently dimensioned lattice pieces can be combined in different lengths and consequently the number of possible setups provided for a parameter can quickly increase.

Such crane control systems assume that all listed parameters or setups have to be clicked through until the required value is displayed for the setup. But this procedure is very cumbersome and time-consuming.

After all required parameters have been given the appropriate setup, the data transfer is initiated by the crane control system when the entry key is activated, and the appropriate carrying load table is searched for by using the selected parameter combination. In this connection, it is conceivable that no table exists for the entered setups. In this case, the crane control system generates an error message and the crane operator is asked to enter all setups once again.

SUMMARY OF THE INVENTION

Since the outfitting time for a crane is a cost factor for the crane operator, such a time-consuming process means a substantial cost disadvantage for the crane owner.

The problem of the present disclosure is therefore to modify a crane control system so as to obviate the above described issues.

This problem is solved by a crane control system with a display and entry unit for showing and entering the crane operating mode information that is required for the load moment limiting and/or the crane control. In particular, this pertains to operating mode information that corresponds to the current mechanical layout of the crane. According to the present disclosure, the crane control system comprises a logic that determines application and/or outfitting related dependencies between two or more input parameters.

The logic determines dependencies present already during the input process between two or more input parameters that have been entered or are yet to be entered. For example, dependencies result from the outfitting condition of the crane or the specific application of the crane, since the possible and therefore appropriate jib length depends on the type of jib system being used.

The logic analyzes, for example, the input parameters to be entered or already entered in terms of whether a dependency exists between at least two input parameters or whether these can be set independently of each other. Moreover, an evaluation of the dependencies found can be carried out by the logic.

In one advantageous embodiment of the present disclosure, the logic of the crane control system is designed such that a selection with possible setups for an input parameter being entered can be generated with consideration of the dependencies that have been found. Accordingly, the user need not tediously work through a list containing all possible setups of the crane, but instead obtains a limited selection of totally sensible setups for the particular input parameter being defined. This produces great time savings for the crane operator when entering the crane configuration.

In this context, it is furthermore conceivable for the logic to be designed so that a selection of the input parameters to be filled out can be generated under consideration of the dependencies. In this way, the user can specifically ask to fill in only the parameters required for the outfitting. For example, the user is shown only the parameters absolutely necessary to enter after one or more immediately preceding entries of setups for certain parameters.

It is also possible for the logic to be designed such that a plausibility check can be carried out between two or more entered input parameters in consideration of the dependencies found. Accordingly, the crane logic evaluates the dependency of the crane parameters already entered during the crane operator's entry. Conflicts between two or more entered input parameters or selected setups of the corresponding parameters are instantly recognized and enable a direct correction to eliminate the conflicts. Contrary to the prior art, such conflicts do not appear only during a final comparison of the selected combination with the carrying load tables saved in memory, but instead can be recognized and corrected at once. Thus, it is not necessary to enter all parameters once again.

It is especially advantageous for the outcome of the plausibility check to be shown optically or acoustically on the display and entry unit of the crane control system. For example, the last entered setup is given a special marking in event of a conflict. It is also possible to mark all entered input parameters or setups involved in the conflict. Accordingly, the user has the option of correcting not the last entered input parameters, but instead to make a change in a previous input value. In this context, it is also conceivable for the control system to automatically show possible correction proposals.

To improve the ergonomic properties of the crane control system, especially the display and entry unit, it is conceivable that this be divided into an information, navigation and editing area. The information area is available for providing selected operating features or parameters. By the navigation area of the display and entry unit, the user can conveniently navigate through the information area and conveniently navigate through the provided selection lists with available setups for the individual input parameters. It is conceivable that the navigation area is divided, first, into the navigation area for the information area and secondly for the navigation area of the editing area.

The editing area serves for direct entry of a setup of one or more input parameters. In this case, the editing area has, e.g., an alphanumeric keypad. Advisedly, the editing area has at least one selection key, by which one or more values from a displayed list can be selected. Furthermore, at least one selection key can be provided that serves to activate the aforesaid selection and releases the transfer of the value or values to the control system.

To further improve the handling and clear view of the crane control system or the display and entry unit, it is advisable to subdivide the input parameters into two or more categories. By the term category, it is meant a forming of different parameters into groups that enable a more efficient entry of the crane configuration.

Moreover, it is possible to hierarchically weigh the individual subdivided input parameters within a category. This means that the selection of a setup for an input parameter must be done in a predefined sequence. Thus, the user cannot choose a setup for any given parameter, but instead has to proceed by the predetermined guidelines. This is especially advantageous when the selection of the available setups is done per input parameter in consideration of the dependencies with preceding input parameters.

The crane control system has a means of evaluating the combination of one or more input parameters entered. The result of the evaluation can then be used to determine the appropriate carrying load table for limiting the load moment of the crane. For example, the means has access to a data medium of the crane control system that contains a number of carrying load tables.

Alternatively, the crane operator can enter a code for the direct selection of a carrying load table in order to bypass the individual manual entry of the required input parameters. This is the fastest way of producing operational readiness for the entire crane.

The code being entered for the carrying load table is a clearly identifiable code composed of several blocks, especially three blocks. It is possible for one block to stand for the definition of the crane type. In this case, there is an automatic default setting of the first block by the crane control system. Another block stands for the choice of a general operating mode group of the crane. This includes, for example, the job configuration, but without indicating physical quantities such as length, angle or weight. An additional block, optionally the last block, is advisedly a nonmeaningful serial number.

In another advantageous embodiment of the crane control system, the system is configured such that an automatic default setting of one or more input parameters is possible under consideration of the crane configuration automatically identified by a provided device. Accordingly, the crane control system itself identifies the outfitting state or the crane configuration and carries out as much as possible an automatic default setting of the individual input parameters for the subsequent determination of the load moment limiting. Such a device is known, for example, from EP 1 598 303 A2, the disclosure content of which is referred to here in its entirety. An automatic recognizing of the crane configuration occurs in this, for example, via a transponder system installed on the crane.

The present disclosure furthermore concerns a crane, especially a mobile or tracked crane, with a crane control system according to one of the aforementioned advantageous embodiments. The crane can obviously have the same advantages and properties as the crane control system according to the present disclosure, so that no further discussion is necessary in this place.

Further advantages and properties of the present disclosure will be discussed more closely below via the figures.

BRIEF DESCRIPTION OF THE FIGURES

FIG. 2 is a schematic representation of a correction procedure for an individual parameter.

DETAILED DESCRIPTION

Figure 1:
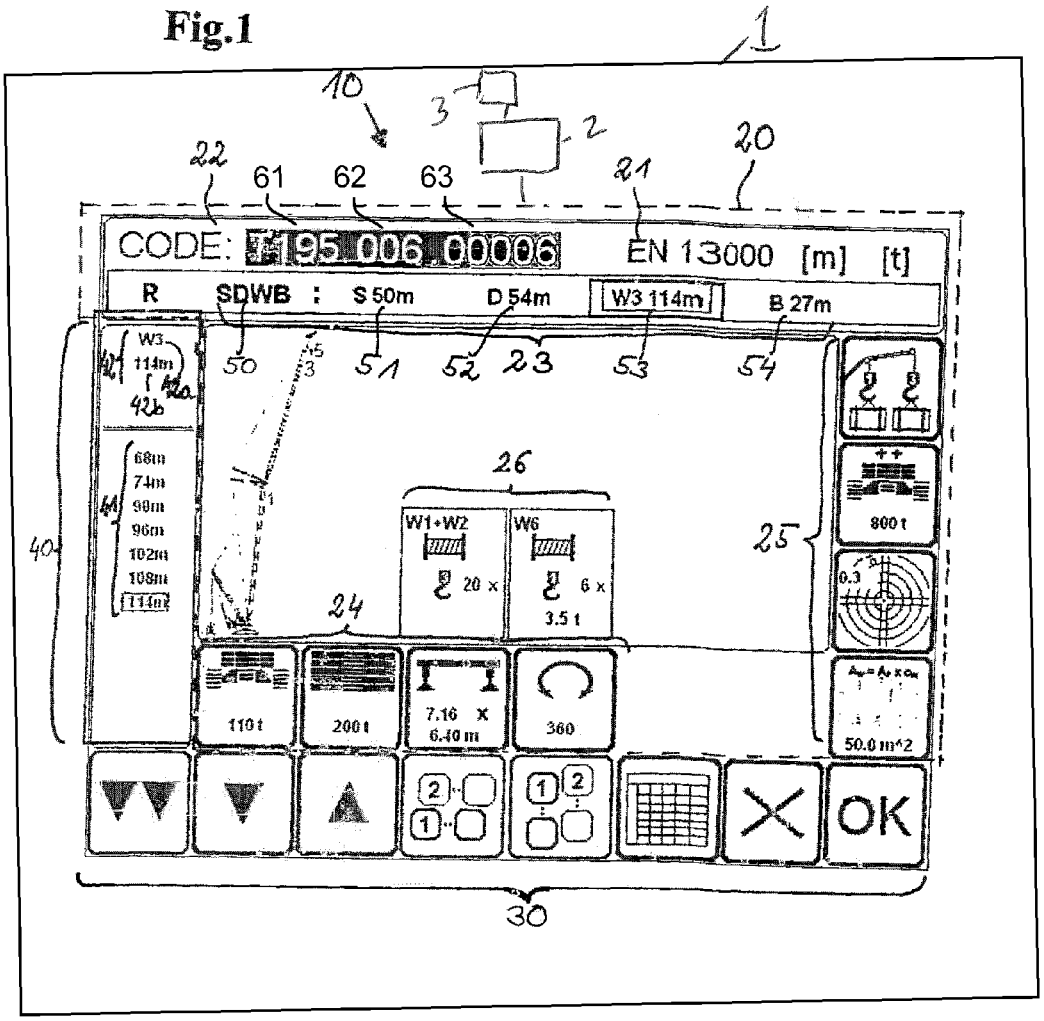
FIG. 1 is an enlarged representation of the display unit of the crane control system of the present disclosure.

First of all, a survey will be made of the following technical terms and abbreviations used. By the term operating mode is meant the basic configuration of the crane 1, which the crane driver defines prior to using the crane and generally leaves it unchanged during the use of the crane. As an example, one can mention the main jib length, derrick jib, installed luffing jib as accessory jib or the mounted derrick ballast, that is, the ballast available for pulling.

The term parameter refers to an individual feature of the crane in the particular usage. These features can be parts of the operating mode or also comprise variable features in the crane usage, such as the current extension length of a telescopic jib being used.

The setup of a parameter denotes the possible properties, i.e., the physical magnitude taken on by a parameter. This includes, for example, the size of the derrick ballast, the size of the central ballast, or the bracing width used.

The general term category is the subsuming of different parameters into groups, enabling an efficient entering of the configuration of the crane.

The general operating mode group, abbreviated in the rest of the specification as "ABG", designates important subassemblies of the overall crane, such as the jib configuration, e.g., consisting of main jib, jib head member or derrick jib with derrick ballast. In this connection, further information as to the special type of the structural parts also belongs to the "ABG." For example, the derrick jib can carry a suspended ballast or alternatively be connected to a ballast truck. The "AGB" code, however, does not indicate the physical magnitudes taken on, such as length, angle or weight.

During the outfitting process, the crane is readied for work, for example, from the transport condition. For this, various inputs need to be provided, such as operating mode information, to the control system of the crane. The crane control system consists of at least one part responsible for the executing of crane movements and a load moment limiting, which monitors the currently experienced load moment in terms of defined limit values. Furthermore, a data storage is provided, which is either connected to the control system or integrated in it, and which prepares the necessary carrying load tables for the load moment limiting. Each carrying load table applies to the particular outfitting condition of the crane and contains the above mentioned limit values.

For the specific selection of at least one suitable carrying load table for the load moment limiting, it is required to enter the current crane configuration, such as ABG, operating mode, parameters and setup.

Essential to the innovative entry function of the crane control system of the present disclosure is the dividing of the monitor screen of the display unit 10 into different areas. The display unit 10 is divided into the information area 20, the navigation area 30 and the editing area 40, while the navigation area 30 can be further subdivided into the navigation area for the information area 20 and the editing area 40.

To ensure good oversight, and representation and improved handling of the crane control system, the individual input parameters are assigned to more informative categories. The individual categories are shown separately in the information area 20. In the example of FIG. 1, the category "Norm" 21 is shown in the information area 20 of the display unit 10. This is dictated by statics for the calculation of a particular set of carrying load tables and is generally independent of the country. The representation shown in FIG. 1. shows the entry for an exemplary regulatory situation, which is used to calculate the allowable carrying load.

Another category shown is the category "Code" 22, which is described in further detail in one of the following paragraphs of the specification.

Other categories shown in the information area 10 are the category "operating mode" 23, which establishes basic data for the crane layout, and the category "supplemental outfitting" 24, which establishes parameters for the crane ballast, the bracing, and the turning range. Lastly, there are the categories "environment and mechanical influences" 25 and the category "lifting" 26. It should be pointed out that the mentioned enumeration is not definitive, but instead can be expanded or restructured as much as desired.

Using the navigation area 30, the crane operator can switch between the individual categories 21 to 26 and change the individual setups of the subordinate categories or features. If the selection options need to be greater than is allowed by an editable display field, the editing area 40 can show a list 41 of possible setups and with the help of the navigation area 30 in the editing area 40 one can select and adopt the desired setup.

The application and/or outfitting related dependencies between two or more input parameters are defined by different systems, according to the type of selected category. For the category of operating mode 23, hierarchical dependencies exist between the input parameters, while the entry system for the categories of supplemental outfitting 24, environment and mechanical influences 25, and lifting 26 provides set theory dependencies between the possible input parameters.

FIG. 1 shows the display unit 10 with the selected category "operating mode" 23. The category "operating mode" 23 consists of the selection feature "general operating mode group (ABG)" 50, which is representative of the existing types of jibs, as well as the corresponding parameters 51, 52, 53, 54, which, for example, take on setups for the physical quantities of the selected jib system. The separating of the operating mode features into available jib types and corresponding physical quantities of the jib system substantially accelerates and simplifies the selection process.

If the field "general operating mode group (ABG)" 50 is marked and occupied by the possible jib combination "SDWB", then the jib types determined by this are automatically displayed as parameters 51, 52, 53, 54 to be defined, so that they can now be filled in with individual physical quantities. The entering is done in a particular sequence, say, from left to right, based on the hierarchical dependencies between the input parameters 51, 52, 53, 54.

In the example of FIG. 1, the luffing jib needs to be defined by selecting the parameter 53 for the luffing jib. In the editing field 40 the two-part editing window is thereupon opened. In the upper section, a subparameter 42 can be selected, if available, which here describes the type of luffing jib 42*a* or the luffing jib length 42*b*. Various physical quantities are possible for the selected subparameter 42, being displayed in the lower part of the two-part editing window 40 as possible setups 41. But only selection options are shown that can be combined with the setups already selected for the other parameters 42, 51, 52, 54. In the example of FIG. 1, e.g., the values 68 m, 74 m, 90 m, 96 m, 102 m, 108 m and 114 m are possible for the subparameter of luffing jib length 42*b* of the parameter luffing jib 53. If the subparameter luffing jib type 42*a* were marked in the upper window area, then the setups W1, W2 or W3 would be displayed in the lower window.

Moreover, the selection of the setup for the luffing jib parameter 53 can determine the range of possible setups that are offered for selection in regard to the parameter 54.

When filling out the parameters in the categories "supplemental outfitting" 24, "environment and mechanical influences" 25 and "lifting" 26, the logic of the crane control system of the present disclosure acts under consideration of the set theory dependencies between the individual input parameters. The selection process here is governed with no particular sequence for selecting the parameters. Any parameter can be entered at any given time, and all available setups of the parameter are always offered. If other parameters are already selected and occupied by corresponding setups, the setups which are suitable and valid for the selection already made are highlighted in color. It is important that the parameter just entered into the control system always becomes the master. After each entry for the setup of a parameter, all other parameters are recalculated as "suitable" or "unsuitable" in terms of their value.

The logic may comprise non-transitory computer readable storage medium with instructions of the various method actions and procedures described herein.

As an additional entry aid, selected setups that are deemed advisable by the crane control system can be marked in color, especially green, while setups for which the crane control system suspects a possible conflict situation are shown in a different color. This functionality is especially advantageous when several parameters are grouped with only a few setups. This can be useful, for example, in the category "supplemental outfitting" 24. Thus, for example, when selecting the setup for a parameter, a setup which cannot be selected—combination with the already selected setups—can be shown in red. If this is selected, all previously filled out parameters of the same category that do not fit the newly selected setup and indicate a possible conflict situation will be shown in blue by the crane control system. The crane operator can quickly and reliably identify possible conflict fields or entry errors and correct them. Furthermore, it is possible to mark as a special color those setups which represent the only valid combination and therefore must not be selected. For example, a sole valid setup for a particular parameter is marked in gray.

A special advantage also consists in that the already selected subparameters or physical quantities/setups remain intact if changes or corrections are needed for one or more quantities/setups. If the crane operator discovers an error after completing the entry of the operating mode information, he can easily make a specific correction to an individual parameter. FIGS. 2*a* to 2*d* illustrate the individual steps of such a correction procedure. The individual blocks designate the selectable setups for the individual parameters 50, 51, 52, 53. Furthermore, the solid line 60 symbolizes the entry performed by the crane operator. For the present example, the setup "SDB" was chosen for the parameter AGB 50, the first subparameter of the parameter 51 defining the main jib was determined with the setup "S" and the length of the jib in the second subparameter was defined as "60". The other parameters/subparameters 52, 53 were filled in with setups "D", "54", "W1".

The broken line 70 shows all possible meaningful combinations of the individual selected setups for the individual parameters/subparameters 50, 51, 52, 53. In particular, the choice made in the example shown, line 60, shows one possible combination of the set of meaningful combinations, line 70. The choice made is consequently deemed to be meaningful by the crane control system.

Figure 2A:
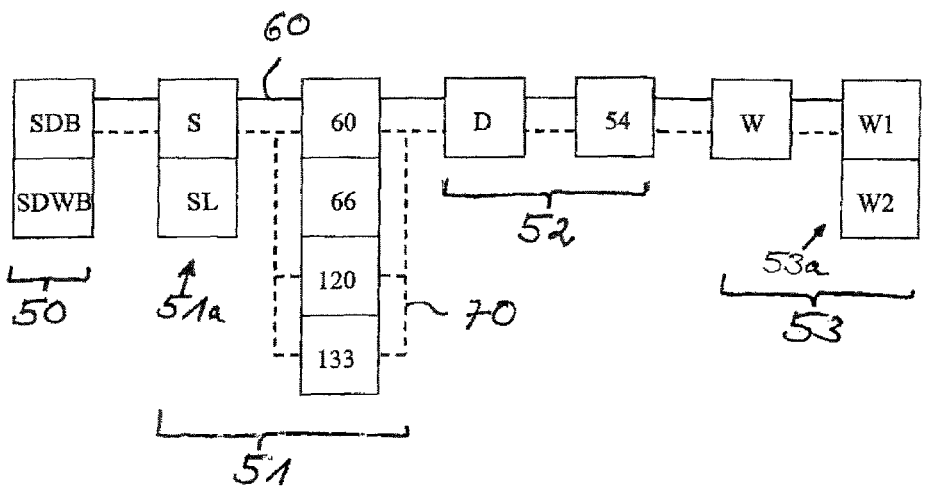
FIG. 2*a* shows the initial state of the setup chose by the crane operator.
Figure 2B:
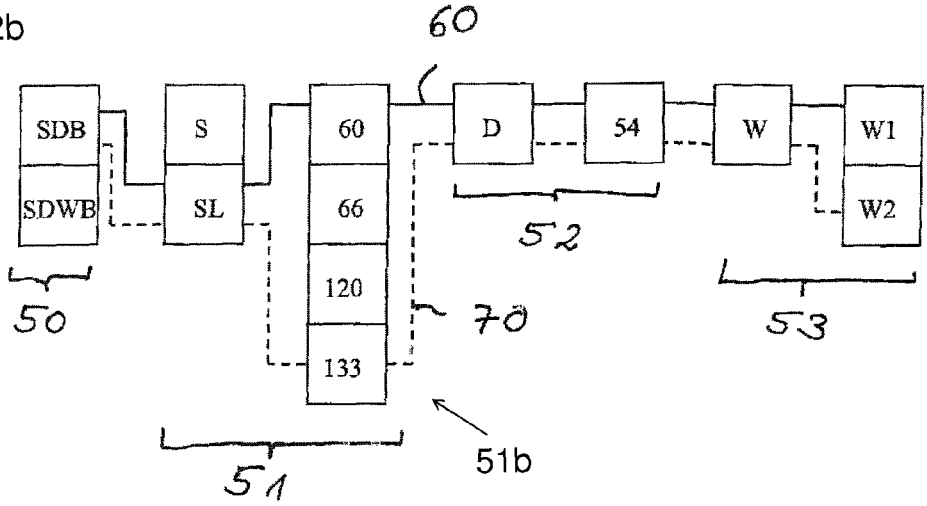
FIG. 2*b* shows the change from a single setup being modified.
Figure 2C:
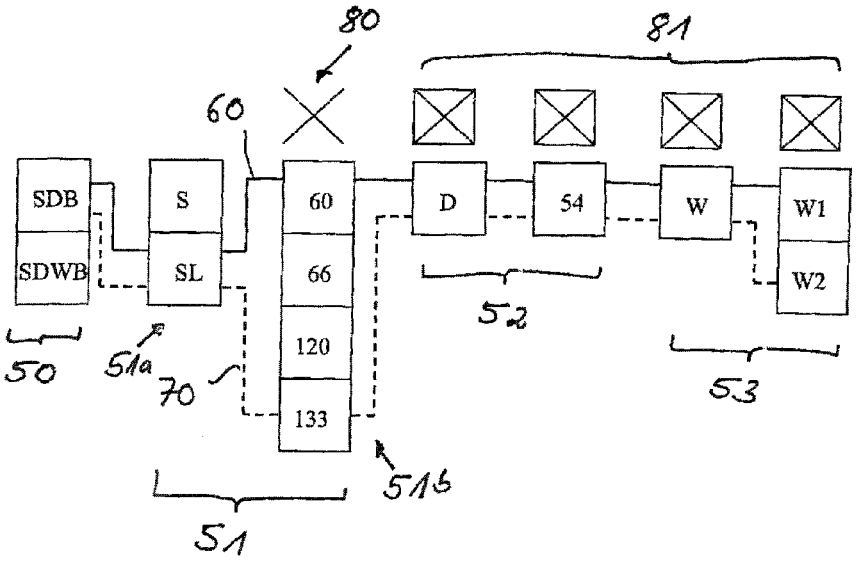
FIG. 2*c* shows the resultant error report expressed.

Now, if the crane operator discovers an erroneous entry, individual parameters/subparameters can be deliberately selected and changed, without losing the rest of the entries. For example, if the subparameter 51*a* for the main jib is to be changed from the setup "S" to the setup "SL". FIG. 2*b* shows the change made, the other selected setups remaining unchanged. Due to the change of the parameter 51, the choice made, line 60, does not represent a valid combination in regard to line 70. Due to the hierarchical weighting of the individual parameters, the crane control system marks the first erroneously set parameter, asking the crane operator to correct the error. Depending on the previously selected setups, only the setup "133" can be selected for the subparameter 51*b*. This should be symbolized to the crane operator by a color highlighting of subparameter 51*b*, for example, by marking the selected setup "60" in red. In FIG. 2*c*, the error report is expressed by the symbol marked with the reference number 80. For the following dependent parameters there is a followup error, marked with reference number 81.

Figure 2D:
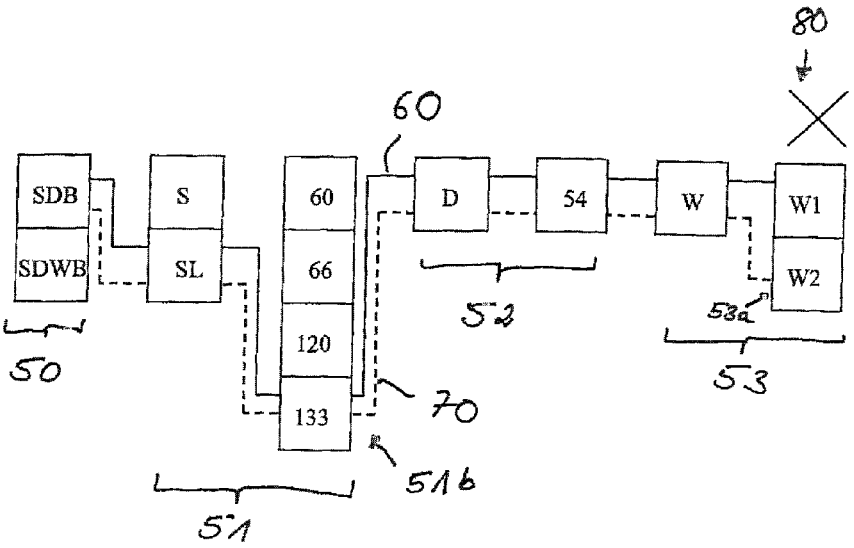
FIG. 2*d* shows the results of correcting the setup error.

If the crane operator changes the entry deemed meaningless for the subparameter 51*b*, the dependencies of the individual entries will be checked again and other error messages might be put out. As shown in FIG. 2*d*, even after correcting the setup for the parameter 51*b* an error message 80 is generated in regard to the subparameter 53*a*.

To further assist the crane operator, a largely independent default setting of the individual parameters set by the crane control can occur by resorting to a device installed aboard the crane for automatic recognition of the crane configuration. The necessary transponder system for the recognition of the crane configuration is known, for example, from EP 1 598 303 A2, to which reference is made here.

For the fastest possible adjusting or entering of the present crane configuration, the crane operator has the option of directly selecting a particular entry of the memorized carrying load table by entering a code in the category "Code" 22. The required code of the carrying load table is of clearly identifiable configuration and composed of a total of three blocks 61, 62, 63.

The first block 61 defines the crane type being used and is always default set by the crane control system itself. The four-place block is subdivided into three numbers, which identify the particular crane types, and the character T to indicate that the respective data set involves a carrying load table.

The second block 62 is called the "high part" and defines the general operating mode group. The third block 63 is called the "low part", it defines the carrying load table and corresponds to a nonmeaningful serial number. All three blocks together form the name of the carrying load table. The parts can be edited separately from each other to reduce the labor of the entry process.

Figure 3:
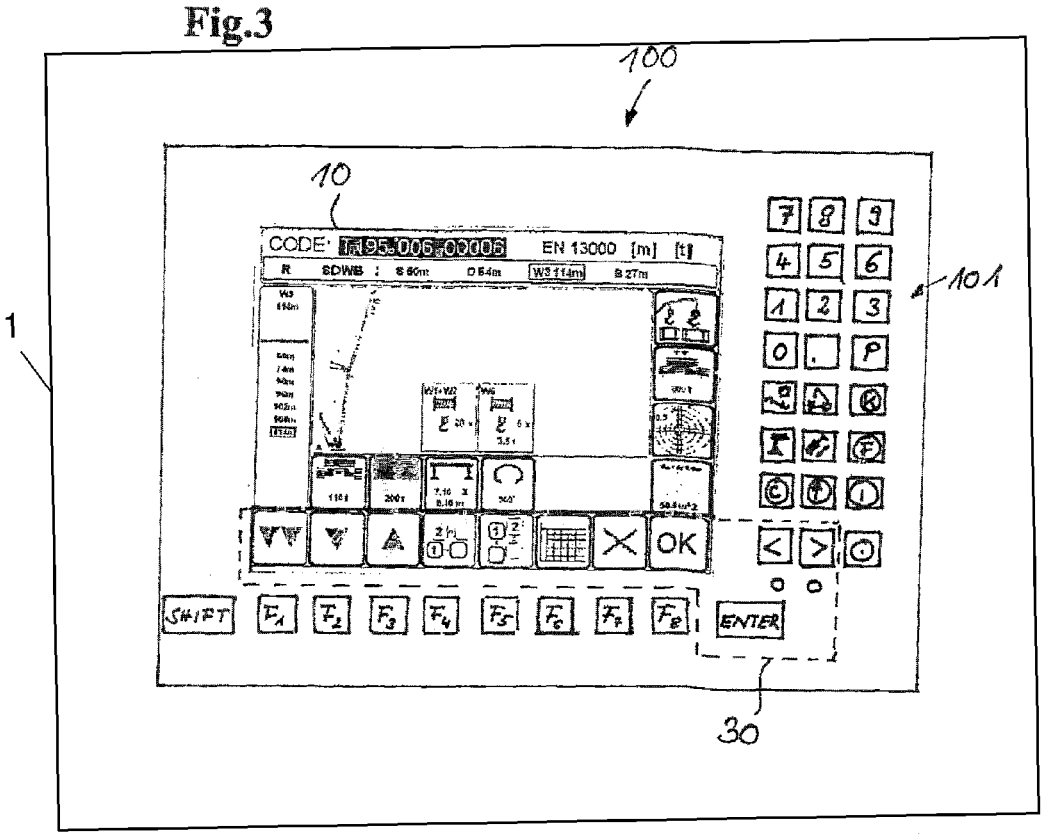
FIG. 3 is a complete drawing of the display and entry unit of the crane control system of the present disclosure.

A complete representation of the display and entry unit 100 is found in FIG. 3. The navigation area 30 extends over the partial area of the display unit 10 and the user keys of the entry unit 101. Certain set values of the crane configuration are editable, which ensures a faster entry process. These entry fields or parameters enable a direct number entry by the keypad 101 after selecting a field with the keys of the editing area 30.

After completing the entry of the necessary parameters, the control system chooses the appropriate carrying load table with the help of the data entered from the memory files and makes this available to the load moment limiting, which thus obtains the suitable limit values for the monitoring. Furthermore, the crane control system identifies the crane geometry and can calculate moments from sensor values (lengths, angles, weight). Moreover, the control system identifies the data of the available jib system in terms of masses and positions of the centers of gravity. These "empty moments" are included in the load moment limiting.

The present disclosure also enables an especially fast outfitting of the crane with as many adjustment options as desired. The crane control system of the present disclosure enables a results-oriented adjusting of the individual crane parameters with plausibility checks throughout the process.

The invention claimed is:

1. A crane control system comprising a display and entry unit for showing and entering crane operating mode information that is required for a load moment limiting and/or crane control, corresponding to a current mechanical layout of a crane, wherein the crane control system further comprises a logic that determines application and/or outfitting related dependencies between two or more user-input parameters, wherein the logic is designed such that a plausibility check is carried out between two or more entered user-input parameters in consideration of the related dependencies found, wherein the logic evaluates the dependencies of crane parameters already entered during a user's entry and recognizes conflicts between two or more entered input parameters or selected setups of the corresponding parameters during the user's entry, and wherein an outcome of the plausibility check is shown optically or acoustically on the display and entry unit.

2. The crane control system according to claim 1, wherein the logic is designed such that a selection, especially a selection list, with possible setups for an input parameter being entered can be generated with consideration of the dependencies that have been found.

3. The crane control system according to claim 1, wherein the logic is designed so that a selection of the input parameters to be filled out can be generated under consideration of the dependencies found.

4. The crane control system according to claim 1, wherein the display and entry unit is divided into an information, navigation and editing area.

5. The crane control system according to claim 4, wherein the editing area is configured such that a direct entry of a setup of at least one input parameter is possible.

6. The crane control system according to claim 1, wherein several input parameters are subdivided into two or more categories.

7. The crane control system according to claim 6, wherein the input parameters within a category are hierarchically weighted.

8. The crane control system according to claim 1, wherein a device is provided for evaluating a combination of one or more input parameters entered and determining an appropriate carrying load table for limiting the load moment.

9. The crane control system according to claim 1, wherein the crane control system is configured such that an automatic default setting of one or more input parameters is possible under consideration of a crane configuration automatically identified by a provided device.

10. A crane, comprising:

a crane control system including a user input device and display;

a plurality of sensors coupled on the crane and communicating with the crane control system;

a logic communicating with the user input device and display, including a load moment limiting and crane control, the logic configured to receive information corresponding to a current mechanical layout of the crane, the logic further configured to determine application and outfitting related dependencies between two or more user-input parameters, wherein the logic is configured such that a plausibility check is carried out between two or more entered user-input parameters based on the determined related dependencies, wherein the logic evaluates the dependency of the crane parameters already entered during a user's entry and recognizes conflicts between two or more entered input parameters or selected setups of the corresponding parameters during the user's entry, and wherein an outcome of the plausibility check is generated optically or acoustically on the display.

11. The crane of claim 10, wherein the crane is a mobile crane.

12. The crane of claim 10, wherein the crane is a tracked crane.

13. The crane of claim 10, wherein the logic is configured such that a selection list is displayed on the display with possible setups for an input parameter being entered, the list generated based on the determined dependencies.

14. The crane of claim 10, wherein the logic is configured so that a selection of the input parameters to be filled out is generated by the logic based on the determined dependencies.

* * * * *